US009153410B2

(12) United States Patent
Sakabe et al.

(10) Patent No.: US 9,153,410 B2
(45) Date of Patent: Oct. 6, 2015

(54) X-RAY GENERATING METHOD, AND X-RAY GENERATING APPARATUS

(76) Inventors: Noriyoshi Sakabe, Tsukuba (JP); Kiwako Sakabe, Tsukuba (JP)

( * ) Notice: Subject to any disclaimer, the term of this patent is extended or adjusted under 35 U.S.C. 154(b) by 1041 days.

(21) Appl. No.: 13/250,475

(22) Filed: Sep. 30, 2011

(65) Prior Publication Data

US 2012/0087475 A1 Apr. 12, 2012

(30) Foreign Application Priority Data

Oct. 12, 2010 (JP) ..... 2010-229572

(51) Int. Cl.
*H01J 35/00* (2006.01)
*H01J 35/26* (2006.01)
*H01J 35/14* (2006.01)

(52) U.S. Cl.
CPC *H01J 35/26* (2013.01); *H01J 35/14* (2013.01)

(58) Field of Classification Search
CPC ..... H01J 35/10; H01J 35/101; H01J 35/26; H01J 35/16; H01J 2235/086; H01J 35/106; H01J 35/28; H01J 35/14; H01J 35/30; H01J 25/00; H01J 35/00; H01J 37/252; H01J 41/04; C30B 29/04; C30B 25/105; G21K 1/087; H05G 2/00; H05G 1/70; H05H 11/00; H05H 15/00; H05H 7/00; H05H 7/12; H05H 7/04
USPC ..... 378/125, 121, 138, 140, 145
See application file for complete search history.

(56) References Cited

U.S. PATENT DOCUMENTS

| | | | | |
|---|---|---|---|---|
| 3,752,989 | A * | 8/1973 | Motz et al. | 378/137 |
| 2006/0104418 | A1* | 5/2006 | Dunham et al. | 378/124 |
| 2007/0104319 | A1* | 5/2007 | Sakabe | 378/125 |
| 2007/0223655 | A1* | 9/2007 | Sakabe | 378/119 |

FOREIGN PATENT DOCUMENTS

JP A-2004-172135 6/2004

* cited by examiner

*Primary Examiner* — Irakli Kiknadze
(74) *Attorney, Agent, or Firm* — Oliff PLC

(57) ABSTRACT

A method for generating an X-ray includes the steps of: disposing at least a target in a chamber; irradiating an electron beam onto the target from an electron beam source disposed in or outside the chamber so as to satisfy a relation of $\beta \leq 60$ degrees if an incident angle of the electron beam is defined as "$\beta$"; and generating and taking an X-ray out of the target so as to satisfy a relation of $-30$ degrees$\leq \beta - \alpha \leq 60$ degrees if an output angle of the X-ray relative to a surface of the target is defined as "$\alpha$".

10 Claims, 2 Drawing Sheets

X-RAY GENERATING METHOD, AND X-RAY GENERATING APPARATUS

CROSS-REFERENCE TO RELATED APPLICATIONS

This application is based upon and claims the benefit of priority from the prior Japanese Patent Application No. 2010-229572, filed on Oct. 12, 2010; the entire contents of which are incorporated herein by reference.

BACKGROUND OF THE INVENTION

1. Field of the Invention

This invention relates to a method for generating an X-ray with high brightness and to an apparatus for generating the same X-ray.

2. Description of the Related Art

In the X-ray diffraction measurement or the like, it is often required that an X-ray with an intensity as high as possible is irradiated onto a sample so as to realize the X-ray diffraction measurement. As such an X-ray generating apparatus as being employed for the X-ray diffraction measurement, an X-ray generating apparatus of rotating anticathode target is conventionally well known.

The rotating anticathode X-ray generating apparatus is configured such that an electron beam is irradiated onto the outer surface of the columnar anticathode target while the columnar anticathode target is rotated under the condition that a cooling medium is flowed in the columnar anticathode target. The rotating anticathode X-ray generating apparatus has an extreme high cooling efficiency because the irradiating portion of the electron beam is varied with time in comparison with an X-ray generating apparatus of stationary target. Therefore, an electron beam can be irradiated onto the anticathode target under the condition of large current to generate an X-ray with high intensity (high brightness).

In this case, however, the intensity of the electron beam to be irradiated per unit area on the target is increased, causing the partial melting for the target and the splashing of the melted target. Therefore, theoretically, the brightness of the x-ray can be increased based on the aforementioned relation, but practically, is restrictive due to the melting point of the target.

In view of the aforementioned problem, such an attempt is made in Reference 1 as irradiating an electron beam onto the inner side of the cylindrical portion of a rotating anticathode X-ray generating apparatus so as to heat the irradiating portion to a temperature equal to or near the melting point of the anticathode target and generate an X-ray with high brightness. In this case, since the irradiating portion of the electron beam is heated to a temperature around the melting point of the rotating anticathode target, the electron beam irradiating portion is at least partially melted. However, since the electron beam irradiating portion is kept against the cylindrical portion by the centrifugal force generated by the rotation of the rotating anticathode target, the partially melted portion of the target, originated from the electron beam irradiation, cannot be splashed outward from the cylindrical portion.

According to Reference 1, therefore, since the intensity of the electron beam to be irradiated can be increased per unit area of the target under the condition that the melting and splashing of the rotating anticathode target are prevented, an X-ray with an relatively higher brightness can be obtained as compared with a conventional one.

[Reference 1] JP-A 2004-172135

In view of high resolution analysis and examination, however, it is required to realize the X-ray with higher brightness.

Moreover, it is desired to realize the X-ray with higher brightness under the condition of low electric power.

BRIEF SUMMARY OF THE INVENTION

It is an object of the present invention to provide a new X-ray generating method and apparatus which can generate an X-ray with high brightness.

In order to achieve the object, the present invention relates to a method for generating an X-ray, including the steps of:

disposing at least a target in a chamber;

irradiating an electron beam onto the target from an electron beam source disposed in or outside the chamber so as to satisfy a relation of $\beta \leq 60$ degrees if an incident angle of the electron beam is defined as "$\beta$"; and generating and taking an X-ray out of the target so as to satisfy a relation of $-30$ degrees$\leq \beta-\alpha \leq 60$ degrees if an output angle of the X-ray relative to a surface of the target is defined as "$\alpha$".

The present invention also relates to An X-ray generating apparatus, including:

a target for generating an X-ray by an irradiation of an electron beam;

a chamber for disposing at least the target therein; and an electron beam source for irradiating the electron beam and disposed in or outside the chamber, wherein the electron beam is irradiated onto the target from an electron beam source so as to satisfy a relation of $\beta \leq 60$ degrees if an incident angle of the electron beam is defined as "$\beta$"; and the X-ray is generated and taken out of the target so as to satisfy a relation of $-30$ degrees$\leq \beta-\alpha \leq 60$ degrees if an output angle of the X-ray relative to a surface of the target is defined as "$\alpha$".

Here, the incident angle $\beta$ and the output angle $\alpha$ are measured by defining the surface of the target as a standard.

The inventor had intensely studied so as to achieve the above-mentioned object. As a result, the inventor has found out that the incident angle of an energy beam, that is, an electron beam so as to generate an X-ray and the output angle of the X-ray importantly affect the brightness of the X-ray. Namely, in a conventional X-ray generating method and apparatus, an electron beam for generating an X-ray is incident on the surface of a target at an angle of about 90 degrees and only the X-ray falling within an output angle range of about 5 to 6 degrees is selectively taken out of the target.

However, when the electron beam is irradiated under the aforementioned condition to take the thus obtained X-ray out of the target, the electron beam is deeply penetrated into the target (electron range $r_e$) so that the X-ray generated at the deep portion of the target travels in the target by a long distance ($r_e/\sin\alpha$) until the X-ray is taken out of the surface of the target. Therefore, the thus generated X-ray is largely absorbed by the target so that the intensity (brightness) of the X-ray is also decreased.

The aforementioned phenomenon becomes conspicuous as the energy of the electron beam, that is, the accelerating voltage for the electron beam is increased.

For example, when an electron beam with an energy of 80 keV is irradiated on a Cu target, the electron beam is penetrated into the Cu target by a depth of about 14 μm. If the output angle of the thus obtained X-ray is 5.7 degrees, the X-ray travels in the target by a distance of 140 μm (about 14 μm/sin 5.7). As a result, the intensity (brightness) of the X-ray is decreased about one-thousandth as high as the intensity (brightness) of an X-ray with no absorption.

In view of the aforementioned fact, therefore, the inventor has investigated variously the brightness of the X-ray by changing the incident angle of the electron beam relative to the target and the output angle, that is, the taking out-angle of the X-ray variously. As a result, the inventor has found out that the brightness of the X-ray can be easily rendered higher by setting the incident angle β of the electron beam relative to the target to a predetermined angle, concretely within a range of 60 degrees or less and setting the output angle (taking out-angle) α of the X-ray to an angle so as to satisfy the relation of −30 degrees≤β−α≤60 degrees.

In other words, the inventor has found out that the X-ray with a high intensity can be easily obtained by improving the corresponding X-ray generating apparatus so as for the incident angle β of the electron beam relative to the target for generating the X-ray and the output angle α of the x-ray to satisfy the above-described relations without a large-scaled improvement for the X-ray generating apparatus.

As is apparent from the aforementioned description, the present invention is realized on the try and error and the finding of the aforementioned phenomenon by the inventor, so that the present invention encompasses the finding of the aforementioned phenomenon.

In an aspect of the present invention, the X-ray can be generated and taken out so as to satisfy the relation of 0 degree≤β−α≤60 degrees. In this case, even if the electron beam with a high energy is irradiated onto the target, the brightness of the X-ray can be easily increased by appropriately selecting and taking out the X-ray with the output angle α satisfying the aforementioned relation.

In another aspect of the present invention, the X-ray can be generated and taken out so as to satisfy the relation of 30 degrees≤β−α≤50 degrees. In this case, even if the electron beam with a low energy is irradiated onto the target, the brightness of the X-ray can be easily increased by appropriately selecting and taking out the X-ray with the output angle α satisfying the aforementioned relation.

Here, the requirement of the output angle α of the X-ray XR when the electron beam with a low energy is irradiated is restricted in comparison with the requirement of the output angle α of the X-ray when the electron beam with a high energy is irradiated. This is because the brightness of the X-ray to be generated and taken out is not much dependent on the output angle α of the X-ray since the electron beam with the low energy is not deeply penetrated into the target. In order to obtain the X-ray with the high brightness under such a relaxed condition as described above, therefore, it is required that the output angle α of the X-ray is strictly selected, resulting in the above-described restriction.

In still another aspect of the present invention, the incident angle β is controlled by adjusting an arrangement of the electron beam source disposed in or outside the chamber or deflecting an orbit of the electron beam using a deflecting magnet disposed in the chamber.

In a further aspect of the present invention, the output angle α is controlled by adjusting a position of formation of an X-ray transparent window.

As described above, according to the present invention can be provided the new X-ray generating method and apparatus which can generate an X-ray with high brightness.

BRIEF DESCRIPTION OF THE SEVERAL VIEWS OF THE DRAWINGS

For better understanding of the present invention, reference is made to the attached drawings.

DETAILED DESCRIPTION OF THE INVENTION hereinafter, the present invention will be described in detail with reference to the drawings.

(First Embodiment)

Figure 1:
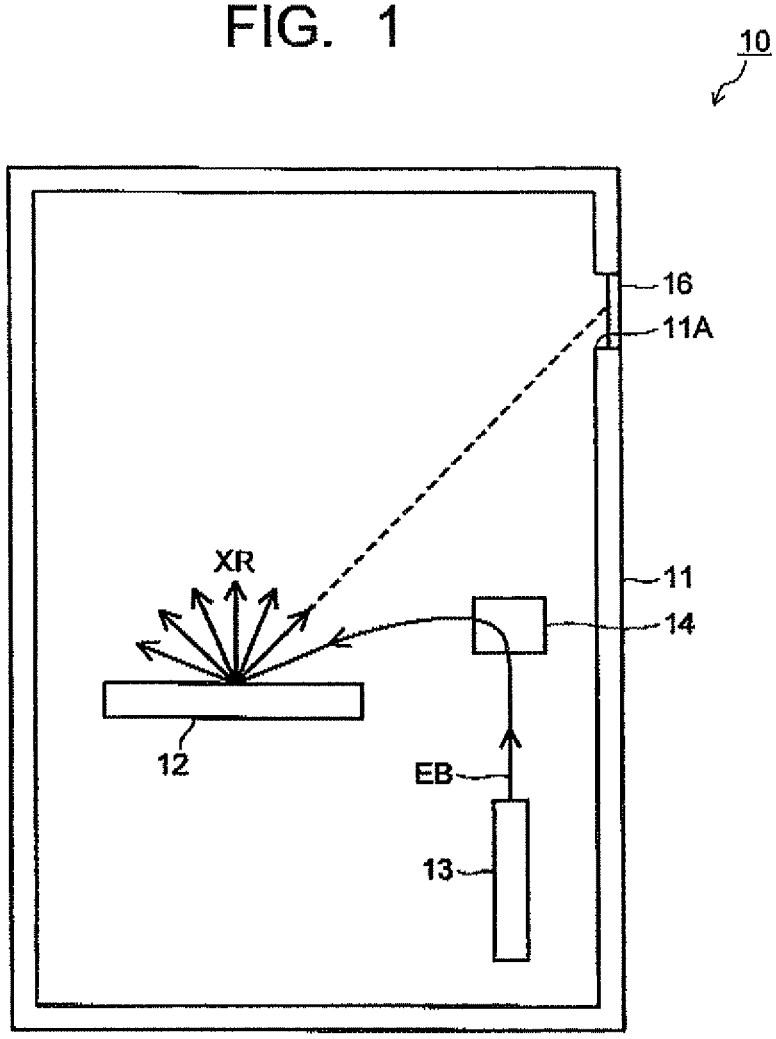
FIG. 1 is a structural view illustrating an X-ray generating apparatus according to a first embodiment of the present invention.

FIG. 1 is a structural view illustrating an X-ray generating apparatus according to an embodiment of the present invention.

An X-ray generating apparatus illustrated in FIG. 1 includes a chamber 11, a target 12 disposed in the chamber 11, an electron beam source 13 and a deflecting magnet 14 which are disposed in the chamber 11 in the same manner as the target 12. An opening is formed at the side wall of the chamber 11 and an X-ray transparent film 16 is formed at the opening 11A. The opening 11A and the X-ray transparent film 16 constitute an X-ray transparent window.

The chamber 11 may be made of, e.g., a stainless steel (SUS). The target 12 may be made of Cu, Co, W, Mo, Cr or the like depending on a wavelength of an X-ray to be generated. The X-ray transparent film 16 may be made of Be, Al or the like. Here, the electron beam source 13 and the deflecting magnet 14 may be made of ones commercially available.

In the X-ray generating apparatus 10 illustrated in FIG. 1, first of all, the chamber 11 is evacuated to a predetermined degree of vacuum, e.g., a pressure within a range of $10^{-6}$ to $10^{-8}$ Pa by means of a evacuating mechanism (not shown), and an electron beam EB is emitted from the electron beam source 13 so that the direction of the electron beam EB is deflected by the deflecting magnet by a predetermined angle. The deflected electron beam is then irradiated onto the target 12 to generate an X-ray XR.

In this case, if the X-ray XR is taken out of the target 12 by setting the incident angle β of the electron beam EB to be irradiated onto the target 12 within a range of 60 degrees or less and satisfying the relation of −30 degrees≤β−α≤60 degree if the output angle of the X-ray is defined as "α", the absorption of the X-ray XR by the target 12 is prevented so as to increase the brightness of the X-ray XR.

Here, the lower limited value of the incident angle β of the electron beam EB is not restrictive only if the electron beam EB can be incident onto the target 12 to generate the X-ray XR. Therefore, the incident angle β may be set to 0 degree or more, practically to 5 degrees.

Since the X-ray XR is taken out of the X-ray transparent film (X-ray transparent window) 16, the position of the formation of the X-ray transparent film (X-ray transparent window) 16 is determined commensurate with, the output angle α satisfying the relation of −30 degrees≤β−α≤60 degree.

Here, the incident angle β and the output angle α are measured by defining the surface of the target 12 as a standard.

The incident angle β of the electron beam EB for the target 12 can be set within the aforementioned range by changing the magnetic field and position of the deflecting magnet 14 depending on the energy (accelerating voltage) of the electron beam EB.

The X-ray can be generated and taken out so as to satisfy the relation of 0 degree≤β−α≤60 degrees. In this case, even if the electron beam EB with a high energy is irradiated onto the target 12, the brightness of the X-ray can be easily increased by appropriately selecting and taking out the X-ray with the output angle α satisfying the aforementioned relation.

The X-ray can be generated and taken out so as to satisfy the relation of 30 degrees≤β−α≤50 degrees. In this case, even if the electron beam EB with a low energy is irradiated onto the target 12, the brightness of the X-ray can be easily increased by appropriately selecting and taking out the X-ray with the output angle α satisfying the aforementioned relation.

Here, the requirement of the output angle α of the X-ray XR when the electron beam EB with a low energy is irradiated is restricted in comparison with the requirement of the output angle α of the X-ray XR when the electron beam EB with a high energy is irradiated. This is because the brightness of the X-ray XR to be generated and taken out is not much dependent on the output angle α of the X-ray XR since the electron beam EB with the low energy is not deeply penetrated into the target 12. In order to obtain the X-ray XR with the high brightness under such a relaxed condition as described above, therefore, it is required that the output angle α of the X-ray XR is strictly selected, resulting in the above-described restriction.

As described, above, in the X-ray generating apparatus 10 in this embodiment, the X-ray with the high brightness can be obtained by improving the apparatus 10 so as for the incident angle β of the electron beam EB for the target 12 and the output angle α of the X-ray XR to satisfy the aforementioned relations.

In this embodiment, the electron beam source 13 is disposed in the chamber 11, but may be disposed outside of the chamber 11 so that the electron beam RE can be introduced into the chamber 11 through an electron beam introducing window or au electron beam inlet formed at the chamber 12.

(Second Embodiment)

Figure 2:
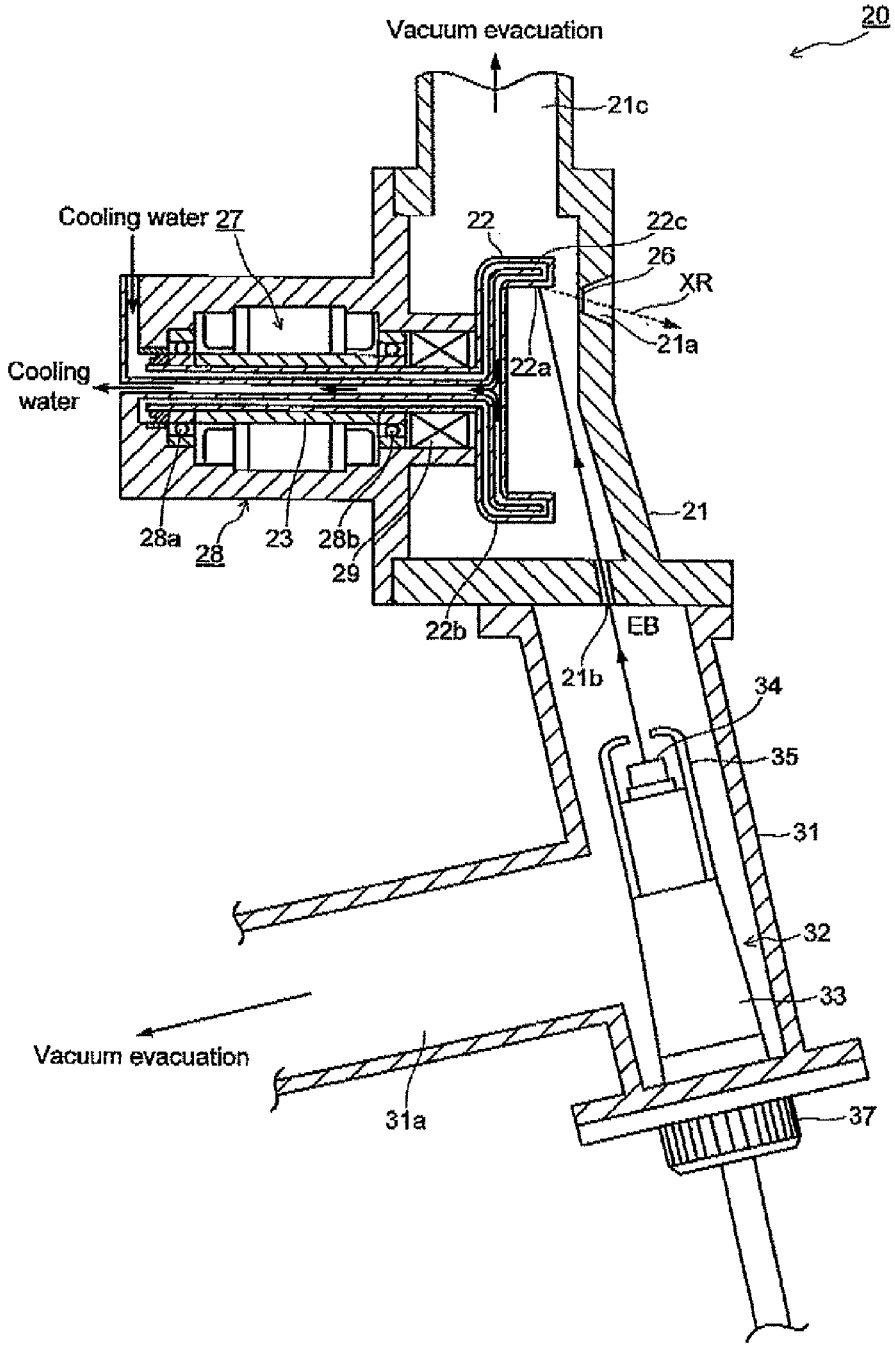
FIG. 2 is a structural view illustrating an X-ray generating apparatus according to a second embodiment of the present invention.

FIG. 2 is a structural view illustrating an X-ray generating apparatus according to an embodiment of the present invention.

An X-ray generating apparatus 20 illustrated in FIG. 2 includes an anticathode chamber 21 for accommodating a rotating anticathode 22, a cathode chamber 31 for accommodating a cathode 32 and a rotation driving portion 28 with a driving motor 27 therein for rotating the anticathode 22 which are located in the vicinity of one another. The anticathode chamber 21 and the cathode chamber 31 are configured as airtight structured chambers, respectively. At the wall of the anticathode chamber 21 in the side of the cathode chamber 31 is formed a small hole 21*b* for passing an electron beam EB 30 to be emitted from the cathode 32 through the small hole 21*b*. Then, at the anticathode chamber 21 and the cathode chamber 31 are provided vacuum outlets 21*c* and 31*a*, respectively to which vacuum pumps (not shown) are connected.

The rotating anticathode 22 includes a cylindrical portion 22*a* made of Cu (copper) or the like, a circular plate 22*b* formed so as to close the one opening of the cylindrical portion 22*a*, and a rotating shaft 23 with a center shaft shared with the cylindrical portion 22*a* and the circular plate 22*b* which are integrally formed. The interior of the circular plate 22*b* is formed in air hole. An electron beam irradiating portion is defined on the inner wall of the cylindrical portion 22*a*.

The rotating shaft 23 of the rotating anticathode 22 is supported rotatably by a pair of bearings 28*a* and 28*b* which are provided in the rotation driving portion 28. The rotating anticathode 22 is rotated by the rotation of the rotating shaft 23 so that a centrifugal force is generated outward from the rotating anticathode 22, that is, a cylindrical portion 22*a*.

At the root of the rotating shaft 23 near the circular plate 22*b* is provided a rotating shaft-sealing member 29 for maintaining the interior of the anticathode chamber 21 in a state of vacuum by maintaining the rotating shaft 23 and the anticathode chamber 21 under an air-tight condition by the rotating shaft-sealing member 29.

In the rotating anticathode 22*a* is inserted a stationary separating member 22*c* for flowing a cooling water along the inner wall of the electron beam irradiating portion. The stationary separating member 22*c* is formed in a cylindrical shape commensurate with the shape of the rotating shaft 23, enlarged along the shape of the circular shape 22*b* and elongated short of the right and left edges of the inner wall of the cylindrical portion 22*a*.

In other words, the stationary separating member 22*c* divides the interior space of the rotating anticathode 22 so as to be a double tube structure. The outer side of the double tube structure is communicated with a cooling water inlet.

Therefore, the introduced cooling water is flowed in the outer side of the double tube structure, returned from the right edge of the inner wall of the cylindrical portion 22*a* and flowed in the inner side of the double tube structure. In this case, the inner wall of the electron beam irradiating portion is cooled by the cooling water, and the remnant cooling water is flowed in the inner side and discharged from a cooling water outlet.

The cathode 32 includes an insulating structural portion 33, a filament 34, a wehnelt 35 and the like, and configured such that the electron beam ER can be irradiated onto the rotating anticathode 22 by the supply of high voltage electric power with several ten kV from a high voltage electric power introducing portion 37 and the supply of filament electric power.

In this case, if the X-ray XR is taken out of the rotating anticathode 22 (cylindrical portion 22*a*) by setting the incident angle β of the electron beam EB to be irradiated onto the rotating anticathode 22 within a range of 60 degrees or less and satisfying the relation of −30 degrees≤β−α≤60 degree if the output angle of the X-ray is defined as "α", the absorption of the X-ray XR by the rotating anticathode 22 (cylindrical portion 22*a*) is prevented so as to increase the brightness of the X-ray XR.

Here, the lower limited value of the incident angle β of the electron beam EB is not restrictive only if the electron beam EB can be incident onto the rotating anticathode 22 (cylindrical portion 22*a*) to generate the X-ray XR. Therefore, the incident angle β may be set to 0 degree or more, practically to 5 degrees.

Since the X-ray XR is taken out of the X-ray transparent film (X-ray transparent window) 26, the position of the formation of the X-ray transparent film (X-ray transparent window) 26 is determined commensurate with the output angle α satisfying the relation of −30 degrees≤β−α≤60 degree.

Here, the incident angle β and the output angle α are measured by defining the surface of the rotating anticathode 22 (cylindrical portion 22*a*) as a standard.

The incident angle β of the electron beam EB for the rotating anticathode 22 (cylindrical portion 22*a*) is controlled by adjusting the position of the cathode 32. In this embodiment, the position of the formation of the cathode chamber 31 relative to the anticathode chamber 21 is adjusted so as to control the incident angle β of the electron beam EB.

The X-ray can be generated and taken out so as to satisfy the relation of 0 degree≤β−α≤60 degrees. In this case, even if the electron beam EB with a high energy is irradiated onto the rotating anticathode 22 (cylindrical portion 22*a*), the brightness of the X-ray can be easily increased by appropriately selecting and taking out the X-ray with the output angle α satisfying the aforementioned relation.

The X-ray can be generated and taken out so as to satisfy the relation of 30 degrees≤β−α≤50 degrees. In this case, even if the electron beam EB with a low energy is irradiated onto the rotating anticathode 22 (cylindrical portion 22*a*), the brightness of the X-ray can be easily increased by appropriately selecting and taking out the X-ray with the output angle α satisfying the aforementioned relation.

Here, the requirement of the output angle α of the X-ray XR when the electron beam EB with a low energy is irradiated is restricted in comparison with the requirement of the output angle α of the X-ray XR when the electron beam EB with a high energy is irradiated. This is because the brightness of the X-ray XR to be generated and taken out is not much dependent on the output angle α of the X-ray XR since the electron beam EB with the low energy is not deeply penetrated into the target 12. In order to obtain the X-ray XR with the high brightness under such a relaxed condition as described above, therefore, it is required that the output angle α of the X-ray XR is strictly selected, resulting in the above-described restriction.

As described above, in the X-ray generating apparatus 20 in this embodiment, the X-ray with the high brightness can be obtained by improving the apparatus 20 so as for the incident angle β of the electron beam EB for the rotating anticathode 22 (cylindrical portion 22*a*) and the output angle α of the X-ray XR to satisfy the aforementioned relations.

In the X-ray generating apparatus 20 of this embodiment, moreover, the electron beam irradiating portion of the cylindrical portion 22*a* of the rotating anticathode 22 is kept against the cylindrical portion 22*a*, that is, the rotating anticathode 22 by the centrifugal force generated in the direction outward from the cylindrical portion 22*a* and generated by the rotation of the rotating shaft 23. In the case where the electron beam EM with a high brightness is irradiated onto the rotating anticathode 22, therefore, even if the electron beam irradiating portion is partially melted, the melted portion cannot be splashed outward since the melted portion is kept by the centrifugal force generated at the cylindrical portion 22*a*. In the X-ray generating apparatus 20 in this embodiment, therefore, the X-ray with a high brightness can be easily generated also due to the structural characteristic of the apparatus 20.

EXAMPLE

Examples 1 to 5 and Comparative Example

The brightness of an X-ray (an actually measured brightness I relative to a theoretical brightness $I_0$) was investigated dependent on the incident angle β of an electron beam and the output angle α of the X-ray by using the x-ray generating apparatus 10 illustrated in FIG. 1. Here, the brightness ($I/I_0$) was calculated (simulated) by the following equation:

$$I/I_0=(\sin\beta/\sin\alpha)\exp(-\mu X)$$

Here, the term "(sin β/sin α)" means a ratio in cross section of the electron beam to the X-ray and the term "μ" means an absorption coefficient of a target. The term "X" gleans a range of the X-ray from the inside to the surface of the target and can be represented as "$r_e$(sin β/sin α)" using a range $r_e$ of the electron beam in the target.

Conventionally, since the electron beam is irradiated vertically on the surface of the target (at an angle of 90 degrees), the incident angle β of the electron beam, which is introduced for the first time in the present invention, is not considered as a variable in view of the brightness of the X-ray. In the present invention, however, since the incident angle β of the electron beam is changed and thus required to be used as a variable, the aforementioned equation is introduced. The aforementioned equation is obvious because the range of the generated X-ray from the inside to the surface of the target is represented as $r_e$(1/sin α) in "BRIEF SUMMARY OF THE INVENTION".

The target 12 is made of Cu and the unit system is represented by "μm". In this case, the term "μ" is 0.041. Moreover, the energy (accelerating voltage) of the electron beam is set to 40 keV. In this case, the range r, of the electron beam in the Cu target is 5.36 μm. The calculated (simulated) results are listed in Table 1.

In the examples, the brightness ($I/I_0$) is often beyond 1 because the term "(sin β/sin α)" is introduced. Namely, if the relation of β>α is satisfied within a range of 0 to 90 degrees, the term "(sin β/sin α)" is beyond 1, so that in the case where the value of the exponential part of the aforementioned equation is relatively large, the brightness ($I/I_0$) is often beyond 1 because the brightness ($I/I_0$) is represented by the multiplication of the term "(sin β/sin α)" and the exponential part.

TABLE 1

| | Incident angle β of electron beam | Output angle α of X-ray | Brightness ratio of X-ray $I/I_0$ |
|---|---|---|---|
| Example 1 | 60 degrees | 5.7 degrees | 1.233 |
| Example 2 | 60 degrees | 10 degrees | 1.667 |
| Example 3 | 60 degrees | 20 degrees | 1.451 |
| Example 4 | 40 degrees | 5.7 degrees | 1.561 |
| Example 5 | 40 degrees | 10 degrees | 1.641 |
| Comparative Example (Conventional Example) | 90 degrees | 5.7 degrees | 1.102 |

As is apparent from Table 1, in the examples, if the incident angle β of the electron beam is set to 60 degrees or less and the output angle of the X-ray satisfies the relation of 30 degrees≤β−α≤50 degrees, the brightness of the X-ray can be increased in comparison with the conventional ones because the energy of the electron beam is set relatively small to 40 keV.

In the X-ray generating apparatus 20 illustrated in FIG. 2, it is required that the relative position between the anticathode chamber 21 and the cathode chamber 31 is changed in order to change the incident angle β of the electron beam, causing a complicated fabrication process for the apparatus 20. Therefore, the calculation (simulation) is conducted for the apparatus 20 on some of the conditions listed in Table 1. As a result, the calculated (simulated) results are similar to the ones in the apparatus 10.

Examples 6 to 18 and Comparative Example

The brightness of an X-ray (an actually measured brightness I relative to a theoretical brightness $I_0$) was investigated dependent on the incident angle β of an electron beam and the output angle α of the X-ray by using the X-ray generating apparatus 10 illustrated in FIG. 1. Here, the target 12 is made of Cu. Moreover, the energy (accelerating voltage) of the electron beam is set to 60 keV. In this case, the range $r_e$ of the electron beam in the Cu target is 9.38 μm. The calculated (simulated) results are listed in Table 2.

TABLE 2

| | Incident angle β of electron beam | Output angle α of X-ray | Brightness ratio of X-ray $I/I_0$ |
|---|---|---|---|
| Example 6 | 60 degrees | 5.7 degrees | 0.305 |
| Example 7 | 60 degrees | 20 degrees | 0.956 |

TABLE 2-continued

| | Incident angle β of electron beam | Output angle α of X-ray | Brightness ratio of X-ray $I/I_0$ |
|---|---|---|---|
| Example 8 | 60 degrees | 40 degrees | 0.802 |
| Example 9 | 60 degrees | 60 degrees | 0.687 |
| Example 10 | 40 degrees | 5.7 degrees | 0.537 |
| Example 11 | 40 degrees | 20 degrees | 0.912 |
| Example 12 | 40 degrees | 40 degrees | 0.687 |
| Example 13 | 40 degrees | 60 degrees | 0.558 |
| Example 14 | 20 degrees | 5.7 degrees | 0.916 |
| Example 15 | 20 degrees | 20 degrees | 0.687 |
| Example 16 | 20 degrees | 40 degrees | 0.434 |
| Example 17 | 5.7 degrees | 5.7 degrees | 0.687 |
| Example 18 | 5.7 degrees | 20 degrees | 0.260 |
| Comparative Example (Conventional Example) | 90 degrees | 5.7 degrees | 0.210 |

As is apparent from Table 2, in the examples, if the incident angle β of the electron beam is set to 60 degrees or less and the output angle of the X-ray satisfies the relation of −30 degrees≤β−α≤60 degrees, the brightness of the X-ray can be increased in comparison with the conventional ones because the energy of the electron beam is set relatively large to 60 keV.

In the X-ray generating apparatus 20 illustrated in FIG. 2, similarly, it is required that the relative position between the anticathode chamber 21 and the cathode chamber 31 is changed in order to change the incident angle β of the electron beam, causing a complicated fabrication process for the apparatus 20. Therefore, the calculation (simulation) is conducted for the apparatus 20 on some of the conditions listed in Table 1. As a result, the calculated (simulated) results are similar to the ones in the apparatus 10.

Examples 19 to 28 and Comparative Example

The brightness of an X-ray (an actually measured brightness I relative to a theoretical brightness $I_0$) was investigated dependent on the incident angle β of an electron beam and the output angle α of the X-ray by using the X-ray generating apparatus 10 illustrated in FIG. 1. Here, the target 12 is made of Cu. Moreover, the energy (accelerating voltage) of the electron beam is set to 80 keV. In this case, the range r, of the electron beam in the Cu target is 13.96 μm. The calculated (simulated) results are listed in Table 3.

TABLE 3

| | Incident angle β of electron beam | Output angle α of X-ray | Brightness ratio of X-ray $I/I_0$ |
|---|---|---|---|
| Example 19 | 60 degrees | 5.7 degrees | 0.058 |
| Example 20 | 60 degrees | 20 degrees | 0.592 |
| Example 21 | 60 degrees | 40 degrees | 0.622 |
| Example 22 | 60 degrees | 60 degrees | 0.563 |
| Example 23 | 40 degrees | 5.7 degrees | 0.158 |
| Example 24 | 40 degrees | 20 degrees | 0.639 |
| Example 25 | 40 degrees | 40 degrees | 0.563 |
| Example 26 | 20 degrees | 5.7 degrees | 0.477 |
| Example 27 | 20 degrees | 20 degrees | 0.563 |
| Example 28 | 5.7 degrees | 5.7 degrees | 0.563 |
| Comparative Example (Conventional Example) | 90 degrees | 5.7 degrees | 0.031 |

As is apparent from Table 3, in the examples, if the incident angle β of the electron beam is set to 60 degrees or less and the output angle of the X-ray satisfies the relation of 0 degree≤β−α≤60 degrees, the brightness of the X-ray can be increased in comparison with the conventional ones because the energy of the electron beam is set relatively large to 80 keV.

In the X-ray generating apparatus 20 illustrated in FIG. 2, similarly, it is required that the relative position between the anticathode chamber 21 and the cathode chamber 31 is changed order to change the incident angle β of the electron beam, causing a complicated fabrication process for the apparatus 20. Therefore, the calculation (simulation) is conducted for the apparatus 20 on some of the conditions listed in Table 1. As a result, the calculated (simulated) results are similar to the ones in the apparatus 10.

Although the present invention was described in detail with reference to the above examples, this invention is not limited to the above disclosure and every kind of variation and modification may be made without departing from the scope of the present invention.

For example, in the examples, the Cu target is employed because the Cu target is easily available and not expensive, but another target such as a Co target, a W target, a Mo target, a Cr target or commercially available may be employed.

What is claimed is:

1. A method for generating an X-ray, comprising the steps of:

disposing at least a target in a chamber;

irradiating an electron beam onto said target from an electron beam source disposed in or outside said chamber so as to satisfy a relation of β≤60 degrees if an incident angle of said electron beam is defined as "β"; and generating and taking an X-ray out of said target so as to satisfy a relation of −30 degrees ≤β−α≤60 degrees if an output angle of said X-ray relative to a surface of said target is defined as "α", wherein said incident ample β is controlled by deflecting an orbit of said electron beam using a deflecting magnet disposed in said chamber.

2. The generating method as set forth in claim 1, wherein said X-ray is generated and taken out of said target so as to satisfy a relation of 0 degree ≤β−α≤60 degrees.

3. The generating method as set forth in claim 1, wherein said X-ray is generated and taken out of said target so as to satisfy a relation of 30 degrees ≤β−α≤50 degrees.

4. The generating method as set forth in claim 1, wherein said output angle a is controlled by adjusting a position of formation of an X-ray transparent window.

5. The generating method as set forth in claim 1, wherein said target is configured as a rotating anticathode with a cylindrical portion having a center axis equal to a rotation center thereof so that said electron beam is irradiated onto an inner wall of said cylindrical portion.

6. An X-ray generating apparatus, comprising:

a target for generating an X-ray by an irradiation of an electron beam;

a chamber for disposing at least said target therein; and an electron beam source for irradiating said electron beam and disposed in or outside said chamber, wherein said electron beam is irradiated onto said target from an electron beam source so as to satisfy a relation of β≤60 degrees if an incident angle of said electron beam is defined as "β"; and said X-ray is generated and taken out of said target so as to satisfy a relation of −30 degrees ≤β−α≤60 degrees if an output angle of said X-ray relative to a surface of said target is defined as "α", wherein said incident angle β is controlled by deflecting an orbit of said electron beams using a deflecting magnet disposed in said chamber.

7. The generating apparatus as set forth in claim 6, wherein said X-ray is generated and taken out of said target so as to satisfy a relation of 0 degree $\leq\beta-\alpha\leq 60$ degrees.

8. The generating apparatus as set forth in claim 6, wherein said X-ray is generated and taken out of said target so as to satisfy a relation of 30 degrees $\leq\beta-\alpha\leq 50$ degrees.

9. The generating apparatus as set forth in claim 6, wherein said output angle $\alpha$ is controlled by adjusting a position of formation of an X-ray transparent window.

10. The generating apparatus as set forth in claim 6, wherein said target is configured as a rotating anticathode with a cylindrical portion having a center axis equal to a rotation center thereof so that said electron beam is irradiated onto an inner wall of said cylindrical portion.

* * * * *